United States Patent [19]

Hagenson

[11] 4,023,859

[45] May 17, 1977

[54] SEAT ANCHOR

[75] Inventor: Leo J. Hagenson, Kenyon, Minn.

[73] Assignee: Foldcraft Company, Kenyon, Minn.

[22] Filed: Jan. 22, 1976

[21] Appl. No.: 651,502

[52] U.S. Cl. ..... 297/158; 297/445; 297/457

[51] Int. Cl.² ..... A47B 83/04

[58] Field of Search ..... 297/158, 157, 440, 445

[56] References Cited

UNITED STATES PATENTS

| | | | |
|---|---|---|---|
| 3,054,156 | 9/1962 | Cohen | 297/440 |
| 3,065,030 | 11/1962 | Gegoux et al. | 297/445 |
| 3,847,424 | 11/1974 | Nielsen | 297/158 |
| 3,858,933 | 1/1975 | Koehring | 297/158 |

*Primary Examiner*—Roy D. Frazier
*Assistant Examiner*—Darrell Marquette
*Attorney, Agent, or Firm*—Neil B. Schulte

[57] ABSTRACT

A seat anchor is provided including an elbow bolt connecting the horizontal portion of a seat support to a vehicle portion thereof attached to the under surface of the seat. This anchor secures the frame of the seat to the bracket, encircling a portion of the frame. The elbow bolt holds the seat from movement relative to the frame.

10 Claims, 9 Drawing Figures

SEAT ANCHOR

This invention relates to an improvement in Seat Support and deals particularly with a means of supporting an elongated seat of the type used in booths and the like.

BACKGROUND OF THE INVENTION

The applicant has been in the business of producing seats of the type used in booths and the like for a considerable length of time. Clips are provided on the under side of the booth having end portions which are secured to the under surface of the booth and in contact therewith. The centers of the clips are all set downwardly in order to accommodate seat securing clips with a frame. The purpose of the present invention is to improve the ease with which the seats may be secured to the supporting frame.

SUMMARY OF THE INVENTION

In my previous U.S. Pat. No., 3,847,424 issued Nov. 12, 1974, I disclosed a booth having seats formed of molded plywood or the like having a seat portion and a seat back. The seat portion is secured to a generally rectangular frame mounted upon suitable supporting legs. Clips are provided, each including laterally extending flanges which engage the frame along its upper and lower surfaces. Bolts extend through the upper and lower flanges of the bracket at the front of the frame at the rear of the frame, a bracket is provided which also extends above and below the frame member. Once the seat is in position on the frame, a bolt extends through the flanges on the forward end of the seat to secure the frames from movement relative to the bracket. A second bolt extends through the lower flange of the rear bracket, and is threaded into the rear bracket 30 to more securely attach the rear of the seat to the frame. In other words, the construction illustrated in the above described patent is similar to the present construction with the exception of the fact that the upper flange of the rear bracket is eliminated and the seat may be more easily attached to the seat.

A feature of the present invention resides in the provision of an L-shaped bolt which extends through a horizontal flange on the front bracket upon which the seat frame is provided. In place of the upper flange of the front bracket, an L-shaped bolt is provided which not only holds the seat frame from movement relative to the brackets, but also simplifies the operation of applying the seat to its supporting frame.

In the present invention the front bracket includes an upper flange which is detachably connected to the clips securing the flange to the seat bottom, a single horizontal flange on which the frame is supported. The front flange also includes a front plate having an offset center portion to accommodate a horizontal flange which engages into the offset central portion of the bracket. In order to secure the frame to the seat, an L-shaped bolt is provided extending through a horizontal flange on the front bracket above the forward portion of the seat frame, and through the vertical flange in a manner to completely enclose the rectangular front member of the frame. Thus, by slightly loosening the screws holding the clips in place and by disconnecting the nut on the end of the L-shaped bolt, the seat may be readily disconnected from the frame for replacement or repair.

These and other objects and novel features of the prsent invention will be more clearly and fully set forth in the following specification and claims.

DESCRIPTION OF THE PREFERRED EMBODIMENTS

Figure 8:
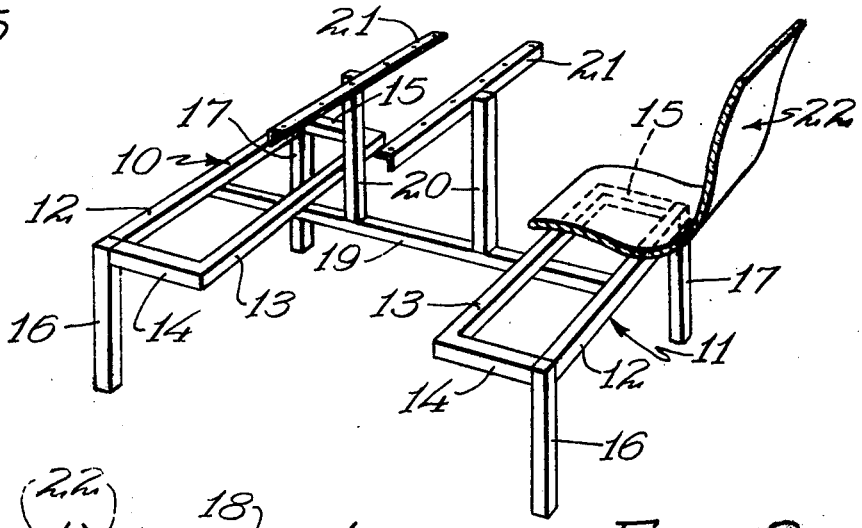
FIG. 8 is a diagrammatic view of the frame with most of the seat detached therefrom.

While the structure of the frame may be varied, FIG. 8 illustrated a supporting means for the seats and the attached table. A pair of rectangular frames 10 and 11 include outer frame members 12 which are preferably of rectangular tubular construction, innerframe members 13 which of similar hollow tubular members and end portions 14 and 15 connecting the ends of the parallel frame members 12 and 13 to form rectangular seat supporting frame. Legs such as 16 support the outer corners of the frames 10 and 11 while similar legs 17 support the outer corners of the rear portions of the frames 10 and 11. A transverse connecting member 19 is welded or otherwise secured to the under surfaces of the rectangular frames 10 and 11 and include spaced uprights 20 which support table supporting angles 21 which support the table top 18 intermediate the seat supporting frames 10 and 11.

The seats 22 are shaped to fit the curvature of the back and seat portions of the seats. The back portions are indicated at 23, and the seat portions are indicated at 24. The seats are formed to conform to the shape of the body so that the opposed edges 25 of the seats are somewhat above the level of the portions 28 of the seats to fit the curvature of the upper portion of the legs.

Figure 6:
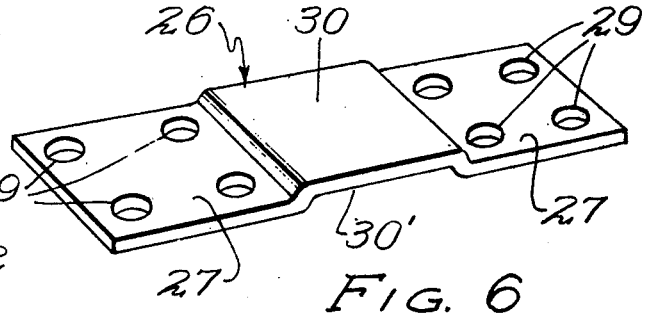
FIG. 6 is a perspective view of one of the clips used to connect the bracket to the under side of the seat.
Figure 7:
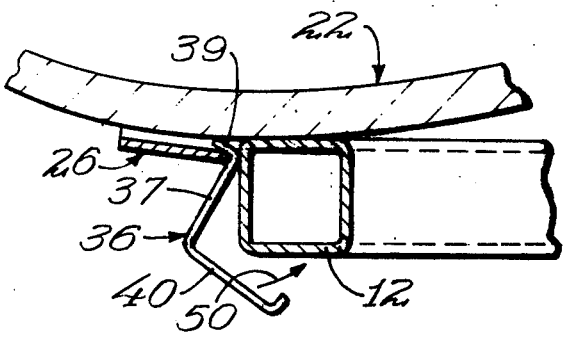
FIG. 7 is a sectional view through the seat and frame showing the forward clips in partially inserted position.

Clips 26 are secured to the under surfaces of the forward portions of the seats 25, and similar clips 26 are secured to the lower portion of the seats 24 to accommodate brackets of a type which will be described. The clips 26, best illustrated in FIG. 6, include coplanar end portions 27 which are apertured as indicated at 29 to accommodate securing screws. Each clip 26 is provided with an offset central portion 30 designed to accommodate a flange of each clip to hold the clip attached to the under suface of the seat 24.

Figure 1:
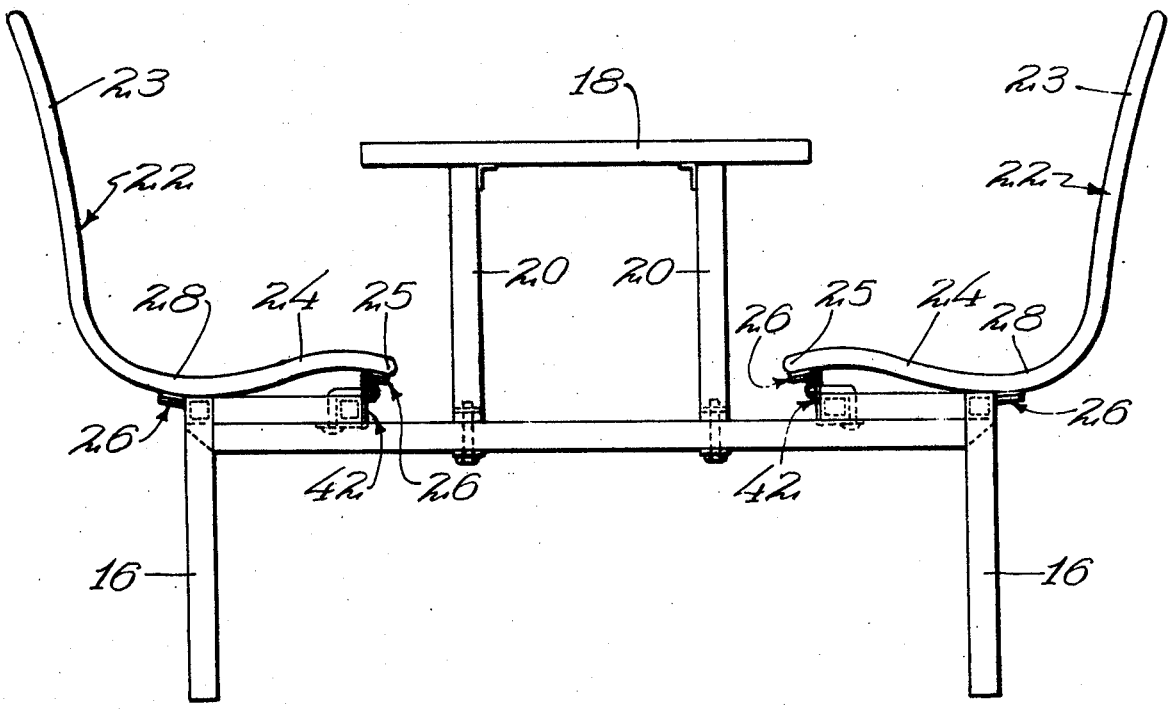
FIG. 1 is an elevational view of the booth showing the general construction thereof.
Figure 2:
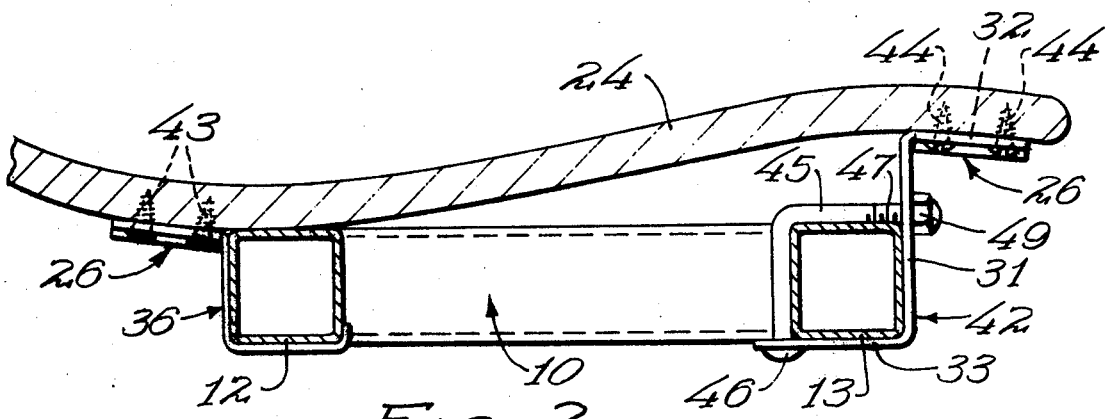
FIG. 2 is a sectional view through the supporting frame and the seat showing the manner in which the seat is connected to the frame.
Figure 3:
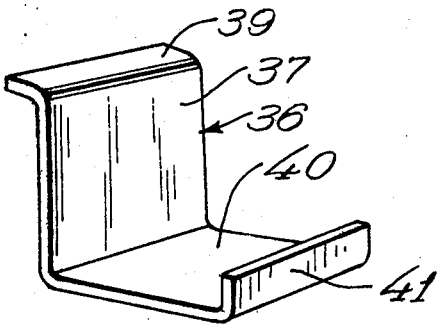
FIG. 3 is a perspective view of one of the clips connecting the rear ends of the seats to the frame.
Figure 4:
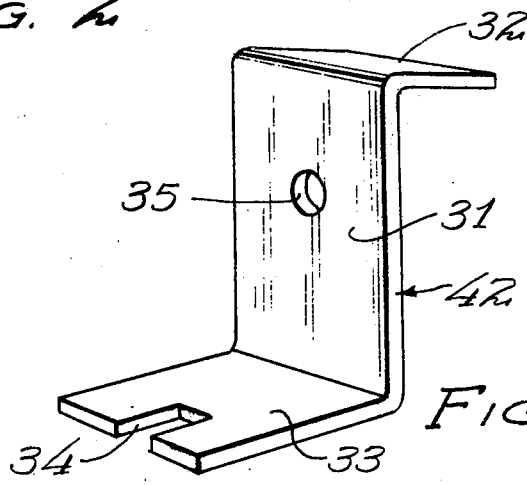
FIG. 4 is a perspective view of the clips securing the forward ends of the seat to the frame.
Figure 5:
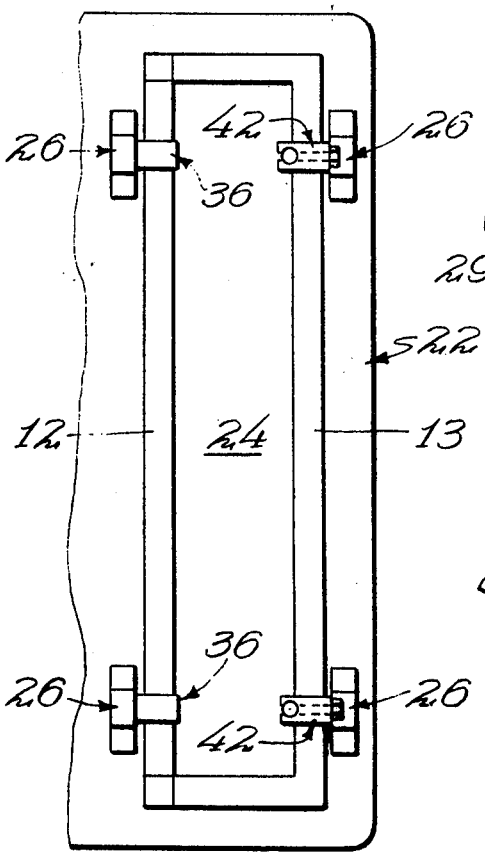
FIG. 5 is a bottom plan view of one of the seats showing the clips attached thereto.

The clip supporting the forward ends of the seat 24 is indicated in general in FIG. 4 of the drawings. Each clip includes a vertical portion 31 including an upper flange 32 which is designed to extend into the aperture 30 provided by the offset central portion 30 of the clips 26. A generally horizontal flange 33 is provided at the lower end of each clip. Each flange 33 is provided with a slot 34 extending into its end extremity and designed to accommodate the headed end of an L-shaped bolt, as will be described. The vertical portion 31 of each clip is provided with an aperture 35 designed to accommodate the threaded end of the right angular bolt as will be described.

The clips 36 designed to secure the rear edges of the frame 10 or 11 includes a vertical portion 37 of a depth substantially equal to the height of the tubular frame 10 or 11 and includes a flange 39 at its upper edge intended to extend into the offset portion of the rear clips 26. The clips 36 include horizontal portions 40 designed to underlie the rear portion 12 of the frame 10 and include a short upwardly extending flange 41 in parallel relation to the vertical portion 36 designed to hold the rear frame member 12 from movement in either direction from the frame member 12.

Figure 9:
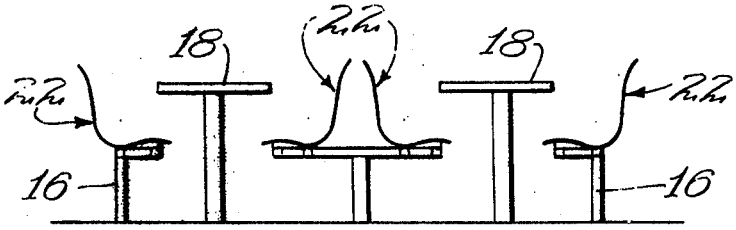
FIG. 9 is a side elevational view of portions of a series of booths showing the general arrangement of the seats relative to the intermediate tables.

In attaching the seats 22 to the frame members 10 and 11, for example, the brackets 36 and 42 are attached to the lower portion of the seat 24 with brackets 26, the attaching screws 43 securing bracket 26 for connecting bracket 36 and the screws 44 securing bracket 26 for connecting bracket 42 are rather loosely inserted into the underside of the seat 24 so that the bracket 36 and 42 may pivot sufficiently to accommodate the frame 10 and 11. An L-shaped bolt 45 having a head 46 is inserted through the slot 34 and the threaded end 47 thereof is inserted through the aperture 35 and the bracket 42 and is held in place by a loosely connected nut 49. As indicated in FIG. 9 of the drawings, the seat is rested upon the frame member 12 and the seat, when resting upon the frame member 12 permits the end 39 of the bracket 36 to extend into the offset center portion 30 of the rear bracket 26. The bracket 36 is swung upwardly in the direction of the arrow 50 to engage the under surface of the frame member 12 and the flange 41 engages inwardly thereof. The screws 43 are then tightened as are the screws 44. The nut 49 engages the end of the bolt 45, the notch 44 permitting the lateral movement of the bolt 45. The nut 49 is tightened to secure both brackets to the seat 24, completing the attachment of the seat to the frame.

In accordance with the Patent Statutes, I have described the principles of construction and operation of my Seat Support, and while I have endeavored to set forth the best embodiments, I desire to have it understood that obvious changes may be made within the scope of the following claims without departing from the spirit of my invention.

I claim:

1. A means of supporting a seat to a frame, said frame having parallel supporting members including:

clips secured to the undersurface of said seat having portions thereof spaced from the undersurface of said seat, brackets having vertical center portions and upper flanges engaged between said seat and said spaced portions of said clips, one of said brackets including a lower supporting flange underlying one of said supporting members and holding said seat from movement relative to said frame, the other of said brackets including a generally horizontal flange at the lower end of said vertical portion extending beneath the other of said supporting members, said horizontal flange having a portion extending beyond the other of said supporting members and toward said one bracket, and an L-shaped bolt having one leg extending through said flange portion of said other bracket and having the other leg extending over said other supporting member and through the vertical center portion of said other bracket to secure said other supporting member to said other bracket.

2. The structure of claim 1 in which said clips including coplanar end portions and an offset center portion.

3. The structure of claim 6 and including means connecting the ends of said parallel frame members to form a rectangular frame.

4. The structure of claim 1 in which said parallel frame members are hollow rectangular tubular members in cross section.

5. The structure of claim 1 in which said upper flanges on said one bracket extend in one direction from the vertical center portions and said supporting flanges extend in the opposite direction from said upper flanges, and said supporting flanges extend at substantially right angles to said vertical center portions.

6. The structure of claim 5 in which said supporting flanges include short upturned end parallel to said vertical center portion of said brackets.

7. The structure of claim 1 in which said horizontal flanges on said other bracket extend at substantially right angles to said vertical center portions.

8. The structure of claim 7 in which said upper flanges on said other bracket extend in opposite directions from said horizontal flanges.

9. The structure of claim 7 in which said flange portions of said other bracket are apertured to accommodate the end of said L-shaped anchoring bolt.

10. The structure of claim 9 in which said apertures comprise slots communicating with the end edges of said horizontal flange portions.

* * * * *